US008449269B2

(12) United States Patent
Yamamori et al.

(10) Patent No.: US 8,449,269 B2
(45) Date of Patent: May 28, 2013

(54) ELECTRIC PUMP AND ELECTRIC PUMP MOUNTING STRUCTURE

(75) Inventors: Motoyasu Yamamori, Nagoya (JP); Noriyasu Hayashi, Anjyo (JP); Daichi Kanda, Kariya (JP)

(73) Assignee: JTEKT Corporation, Osaka (JP)

( * ) Notice: Subject to any disclaimer, the term of this patent is extended or adjusted under 35 U.S.C. 154(b) by 308 days.

(21) Appl. No.: 12/954,738

(22) Filed: Nov. 26, 2010

(65) Prior Publication Data

US 2011/0129364 A1 Jun. 2, 2011

(30) Foreign Application Priority Data

Dec. 1, 2009 (JP) ..... 2009-273215
Feb. 17, 2010 (JP) ..... 2010-032095

(51) Int. Cl.
*F04B 35/04* (2006.01)
*F04B 17/03* (2006.01)

(52) U.S. Cl.
USPC ..... 417/354; 417/410.4

(58) Field of Classification Search
USPC ..... 417/356, 410.4; 29/888.02, 888.023
See application file for complete search history.

(56) References Cited

U.S. PATENT DOCUMENTS

| | | | | |
|---|---|---|---|---|
| 2,760,348 | A * | 8/1956 | McAdam | 62/510 |
| 2,761,078 | A * | 8/1956 | McAdam | 310/67 R |
| 5,145,329 | A * | 9/1992 | Zumbusch et al. | 417/356 |
| 6,390,947 | B1 | 5/2002 | Aoki et al. | |
| 2005/0265860 | A1 * | 12/2005 | Kameya et al. | 417/410.4 |
| 2010/0129239 | A1 * | 5/2010 | Hadar et al. | 417/410.4 |

FOREIGN PATENT DOCUMENTS

| | | |
|---|---|---|
| JP | A-2001-099282 | 4/2001 |
| JP | A-2003-129966 | 5/2003 |

* cited by examiner

*Primary Examiner* — Charles Freay
(74) *Attorney, Agent, or Firm* — Oliff & Berridge, PLC

(57) ABSTRACT

An electric pump includes: a second housing and a first housing separated from each other in an axial direction; a stator portion that accommodates an annular coil portion; an outer rotor portion that is rotated based on a magnetic field generated by the coil portion, at a position on the inner side of the housings; and an inner rotor that is rotatably supported by a support shaft portion having an axis that is offset from that of the outer rotor portion, and that has an outer peripheral surface that is engaged with an inner peripheral surface of the outer rotor portion. The second housing is fitted onto the support shaft portion, to which the first housing has been fixed, from one side of the support shaft portion in the axial direction. As a result, the outer rotor portion and the stator portion are clamped between the first housing and the second housing from both sides in the axial direction.

6 Claims, 9 Drawing Sheets

ELECTRIC PUMP AND ELECTRIC PUMP MOUNTING STRUCTURE

INCORPORATION BY REFERENCE

The disclosure of Japanese Patent Applications No 2009-273215 filed on Dec. 1, 2009 and No. 2010-032095 filed on Feb. 17, 2010, including the specifications, drawings and abstracts, is incorporated herein by reference in its entirety.

BACKGROUND OF THE INVENTION

1. Field of the Invention

The invention relates to an electric pump. More particularly, the invention relates to an electric pump that is reduced in size in the axial direction by arranging an electric motor on the radially outer side of a pump and integrating a permanent magnet of the electric motor with an outer gear of the pump.

2. Description of the Related Art

In a vehicle in which an engine automatic stop control for stopping or starting an engine based on the operating state of the vehicle is executed, it is necessary to ensure required hydraulic pressure for a hydraulic circuit of a transmission at the time of engine start. Therefore, the vehicle in which the engine automatic stop control is executed includes an electric pump that supplies hydraulic pressure to the hydraulic circuit of the transmission at the time of engine start, in addition to a mechanical pump that supplies hydraulic pressure using the rotation of the engine (see Japanese Patent Application Publication No. 2001-99282 (JP-A-2001-99282)). A vehicle that employs an anti-lock brake system (hereinafter, referred to as "ABS") includes an electric pump for the ABS control in order to ensure required hydraulic pressure for activating the ABS. Preferably, these electric pumps should be as small as possible in view of the mounting space.

Japanese Patent Application Publication No. 2003-129966 (JP-A-2003-129966) describes an electric pump that is reduced in size in the axial direction by arranging an electric motor on the radially outer side of a pump and integrating a permanent magnet of the electric motor with an outer gear of the pump. FIG. 5 shows an axial sectional view of an existing electric pump 110 having a similar structure to that of the electric pump described in JP-A-2003-129966. The electric pump 110 is formed by arranging a stator portion 122 and a permanent magnet 124 that constitute a motor 120 on the radially outer side of an outer gear 132 and inner gear 134 that constitute a pump 130 and connecting the permanent magnet 124 of the motor 120 with the outer gear 132 of the pump 130. Then, the motor 120 and the pump 130 are arranged between a housing 140 and a housing 142, and the housing 140 and the housing 142 are connected to each other when a bolt 144 is passed through a flange 141 and a flange 143 that are formed at ends of the housing 140 and the housing 142, respectively. Then, when the stator portion 122 is energized, the permanent magnet 124 of the motor 120 and the outer gear 132 of the pump 130 rotate together with each other, and the inner gear 134 of the pump 130 is rotated in accordance with the rotation of outer gear 132. As a result, pumping action is produced. However, in the motor oil pump shown in FIG. 5, the flanges need to be formed at the housings in order to connect the housings to each other. This leads to an increase in size of the electric pump in the radial direction. In addition, the bolt for connecting the flanges to each other is required. This leads to an increase in the number of components.

SUMMARY OF INVENTION

It is an, object of the invention to provide an electric pump and an electric pump mounting structure with which the number of components is reduced and an assembly work is simplified.

An aspect of the invention relates to an electric pump including: a housing; an annular stator portion that has a coil portion; an outer rotor portion that is arranged coaxially with the stator portion, at a position on an inner side of the stator portion, and that is rotated based on a magnetic field generated by the coil portion; and an inner rotor that is rotatably supported, at a position on an inner side of the outer rotor portion, by a support shaft portion that is supported at an axial position offset from a rotation axis of the outer rotor portion, and that has an outer peripheral surface that is engaged with an inner peripheral surface of the outer rotor portion.

The housing is formed of a first housing and a second housing that are separated from each other in an axial direction. The first housing is fixed to the support shaft portion. The second housing is fitted onto the support shaft portion from one side of the support shaft portion in the axial direction, and is fixed to a portion of the support shaft portion, the portion being on the one side. The stator portion is clamped between the first housing and the second housing fixed to the support shaft portion from both sides in the axial direction, and the outer rotor portion and the inner rotor are rotatably held between the first housing and the second housing from both sides in the axial direction.

With the above structure, flanges for assembly are no longer required. Therefore, it is possible to reduce the size of the electric pimp in the radial direction, and to make the mounting surface on which the electric pimp is mounted small. In addition, a bolt used to fitting the housings together is no longer required. Therefore, the number of components is reduced. Then, the electric pump may be formed just by press-fitting the second housing onto the support shaft portion to which the first housing has been fixed, which makes assembly work easy.

BRIEF DESCRIPTION OF DRAWINGS

The foregoing and further features and advantages of the invention will become apparent from the following description of example embodiments with reference to the accompanying drawings, wherein like numerals are used to represent like elements and wherein.

DETAILED DESCRIPTION OF EMBODIMENTS

Hereinafter, embodiments of the invention will be described.

Figure 1:
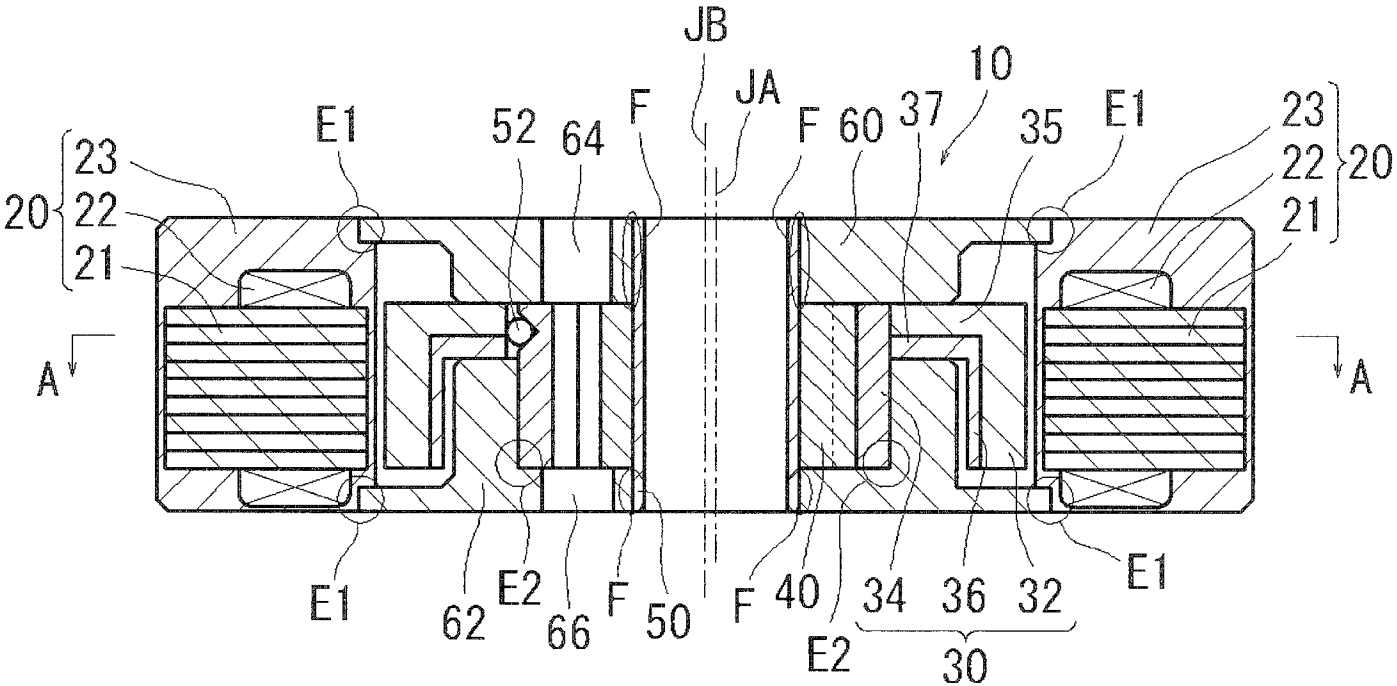
- FIG. 1 is an axial sectional view of an electric pump according to a first embodiment.
Figure 2:
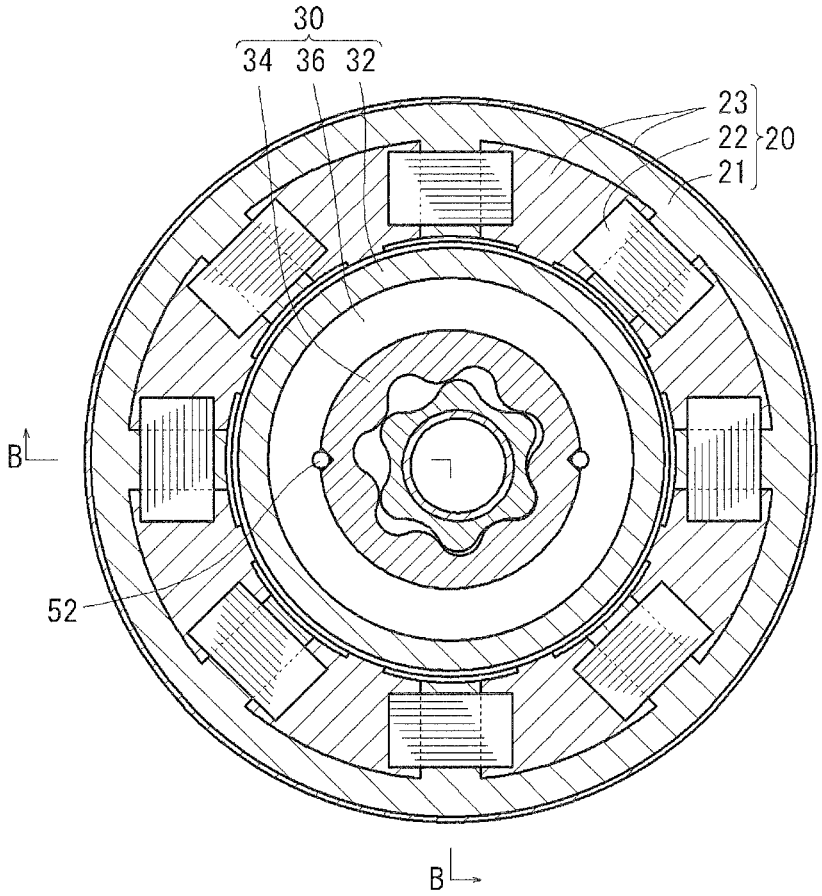
- FIG. 2 is a cross-sectional view taken along the line A-A in FIG. 1.

First, the structure of an electric pump according to a first embodiment will be described. FIG. 1 is an axial sectional view of an electric pump 10 according to the first embodiment of the invention, FIG. 2 shows a cross-sectional view of the electric pump 10 taken along the line A-A in FIG. 1. Note that the sectional view shown in FIG. 1 shows an axial sectional view taken along the line B-B in FIG. 2.

The electric pump 10 has a disc-shape with a diameter of 70 mm and a thickness of 20 mm. As shown in FIG. 1 and FIG. 2, the electric pump 10 includes a housing 60 (corresponding to a second housing), a housing 62 (corresponding to a first housing), a stator portion 20 having a coil portion 22, an outer rotor portion 30, an inner rotor 40 and a support shaft portion 50. In FIG. 1, JA indicates the central axis of the support shaft portion 50, and JB indicates the central axis of the electric pump 10.

The stator portion 20 is formed by performing an in-mold process for an annular core 21 having the coil portion 22 formed by wounding coils around teeth. That is, the surface of the stator portion 20 is covered with a resin 23, and the resin 23 is provided around the coil portion 22. The outer rotor portion 30 is structured so as to be rotated based on the magnetic field generated by the coil portion 22, at a position on the inner side of the housing 60 and the housing 62. Then, the inner rotor 40 is rotatably supported by the support shaft portion 50 that has the central axis JA which is offset from the central axis JB of the outer rotor portion 30, and the inner peripheral surface of the outer rotor portion 30 is engaged with the outer peripheral surface of the inner rotor 40.

The housing 60 and the housing 62 are substantially disc-shaped aluminum members having holes, into which the support shaft portion 50 is press-fitted, at their centers. One of the sides of each of the housings 60 and 62 is formed in a flat surface that constitutes the outer surface of the electric pump 10, and the other side of each of the housings 60 and 62 has a protrusion. The outer rotor portion 30 and the inner rotor 40 are clamped between the protrusions of the housings 60 and 62. The housing 60 has an outlet 64, through which fluid (for example, oil) is discharged, at a radial position that is on the boundary between the outer rotor portion 30 and the inner rotor 40. The housing 62 has an inlet 66, through which the fluid is introduced, at a radial position that is on the boundary between the outer rotor portion 30 and the inner rotor 40. Note that, in FIG. 1, the outlet 64 and the inlet 66 are drawn on the same cross section; however, actually, the phase of the outlet 64 is offset from the phase of the inlet 66.

The outer rotor portion 30 is formed of an outer gear 34, a plastic magnet 32 and a back yoke 36. The inner peripheral surface of the outer gear 34 is engaged with the inner rotor 40. The plastic magnet 32 is rotated based on the magnetic field generated by the coil portion 22. The plastic magnet 32 is a substantially cylindrical permanent magnet that is formed by mixing plastic with magnet powder. An end portion of the plastic magnet 32, the end portion being on the housing 60-side, extends radially inward to form a rib 35. The substantially cylindrical back yoke 36 is stuck on the radially inner side of the plastic magnet 32 to integrate the plastic magnet 32 with the back yoke 36. An end portion of the back yoke 36, the end portion being on the housing 60-side, extends radially inward to form a rib 37. As shown in FIG. 2, two cutouts are formed in the outer periphery of the outer gear 34, and axial grooves are formed at two portions of each of the inner peripheral surface of the rib 35 of the plastic magnet 32 and inner peripheral surface of the rib 37 of the back yoke 36. Balls 52 for stopping rotation are placed between the cutouts and the grooves, and rotation of the plastic magnet 32 and back yoke 36 is transmitted to the outer gear 34.

At portions indicated by E1 in FIG. 1, the housing 60 and the housing 62 are spigot-engaged with the stator portion 20, and, at a portion indicated by E2 in FIG. 1, the housing 62 is spigot-engaged with the outer gear 34. At portions indicated by F in FIG. 1, the housing 60 and the housing 62 are press-fitted on the support shaft portion 50. The outer rotor portion 30 is clamped between the housing 60 and the housing 62 from both sides in the axial direction, and the outer rotor portion 30 is rotatable. That is, one axial end surface of the outer rotor portion 30 is guided by an axial end surface of the housing 60, which faces the one axial end surface of the outer rotor portion 30, and the other axial end surface of the outer rotor portion 30 is guided by an axial end surface of the housing 62, which faces the other axial end surface of the outer rotor portion 30.

The stator portion 20 is fixedly clamped between the housing 60 and the housing 62 from both sides in the axial direction. In addition, the inner rotor 40 is clamped between the housing 60 and the housing 62 in the axial direction, and the inner rotor 40 is rotatable in accordance with the rotation of the outer rotor portion 30. That is, one axial end surface of the inner rotor 40 is guided by an axial end surface of the housing 60, which faces the one axial end surface of the inner rotor 40, and the other axial end surface of the inner rotor 40 is guided by an axial end surface of the housing 62, which faces the other axial end surface of the inner rotor 40.

A minute axial gap, through which fluid (for example, oil) is able to flow, is formed at each of a position between the one axial end surface of the outer rotor portion 30 and the axial end surface of the housing 60, which faces the one axial end surface of the outer rotor portion 30, and a position between the other axial end surface of the outer rotor portion 30 and the axial end surface of the housing 62, which faces the other axial end surface of the outer rotor portion 30. In addition, a minute axial gap, through which fluid is able to flow, is also formed at each of a position between one axial end surface of the inner rotor 40 and the axial end surface of the housing 60, which faces the one axial end surface of the inner rotor 40, and a position between the other axial end surface of the inner rotor 40 and the axial end surface of the housing 62, which faces the other axial end surface of the inner rotor 40.

Next, a method of assembly of the electric pump according to the first embodiment will be described. The assembly of the electric pump 10 is performed in accordance with the following procedure. First, the inner rotor 40 is fitted on the support shaft portion 50 at a predetermined axial position. Next, the outer rotor portion 30 and the stator portion 20 are fitted onto the support shaft portion 50. Then, the housing 60 and the housing 62 are press-fitted onto the support shaft portion 50 from respective axial ends of the support shaft portion 50, in such a manner that the inner rotor 40, the outer rotor portion 30 and the stator portion 20 are clamped between the housing 60 and the housing 62. At this time, the protrusions formed on the back surfaces of the housing 60 and housing 62 determine the position of the inner rotor 40 in the axial direction and the position of the outer rotor portion 30 in the axial direction and in the radial direction. Then, the position of the stator portion 20 in the axial direction and in the radial direction is determined by spigot-engagement of the housing 60 and housing 62 with the stator portion 20. When the flat surfaces of the housing 60 and housing 62 become flush with the axial end surfaces of the support shaft portion 50, press-fitting of the housing 60 and housing 62 on the support shaft portion 50 is completed. At this time, the surfaces of the stator portion 20 in the axial direction are also flush with the flat surfaces of the housing 60 and housing 62. Note that, the housing 62 may first be press-fitted on the support shaft portion 50, the stator portion 20 may be spigot-engaged with the housing 62, the outer rotor portion 30 may be fitted to the support shaft portion 50, and then the housing 60 may be press-fitted on the support shaft portion 50.

According to the first embodiment, the housing 60 and the housing 62 are press-fitted onto the support shaft portion 50 from respective axial ends of the support shaft portion 50, in such a manner that the inner rotor 40, the outer rotor portion 30 and the stator portion 20 are clamped between the housing 60 and the housing 62. As a result, the electric pump 10 is formed. The paired housing 60 and housing 62 are fixedly connected to the stator portion 20 through spigot-engagement. This makes it easy to fit the housings with a high degree of accuracy. Thus, the housings 60 and 62 no longer require flanges used to fit the housings to each other. Therefore, the electric pump 10 is reduced in size in the radial direction, and the mounting surface for the electric pump 10 is made small. In addition, a bolt used to fit the flanges to each other is no longer required. Therefore, the number of components may be reduced. Further, assembly of the electric pump 10 is performed just by press-fitting the housing 60 and the housing 62 on the support shaft portion 50, which makes the assembly work easy. In the electric pump described above, flanges used to fit the housing to each other are no longer required, and a bolt used to fit the flanges to each other is no longer required. Thus, it is possible to provide the electric pump which is reduced in size in the radial direction, which requires a small mounting surface, and with which the number of components is reduced and the assembly work is simplified. Further, it is possible to easily fix the electric pump to a mounting-target member by passing a bolt through a through-hole of the support shaft portion 50. The balls 52 are placed between the cutouts formed in the outer periphery of the outer gear 34 and the grooves formed in the inner peripheral surface of the rib 35 of the plastic magnet 32 and the inner peripheral surface of the rib 37 of the back yoke 36, whereby power is transmitted from the back yoke 36 to the outer gear 34. This makes it possible to simplify machining of a power transmitting portion.

Figure 3:
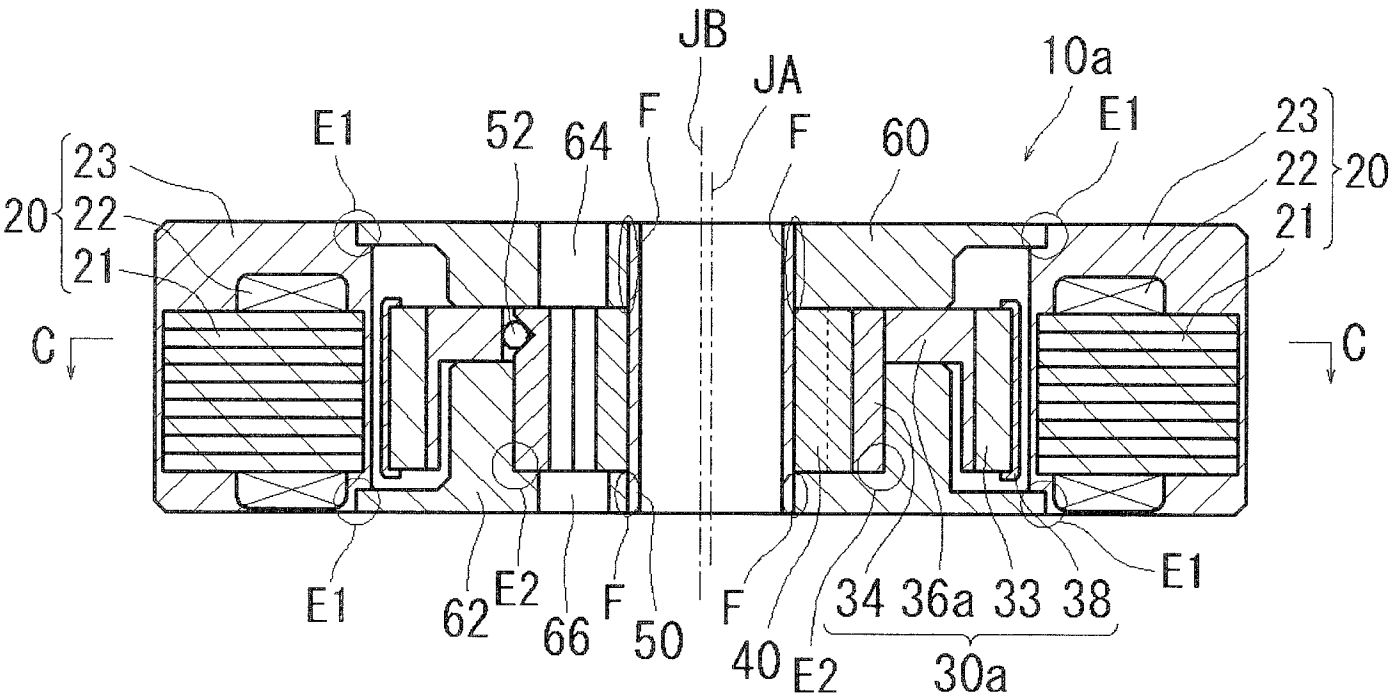
- FIG. 3 is an axial sectional view of an electric pump according to a second embodiment.
Figure 4:
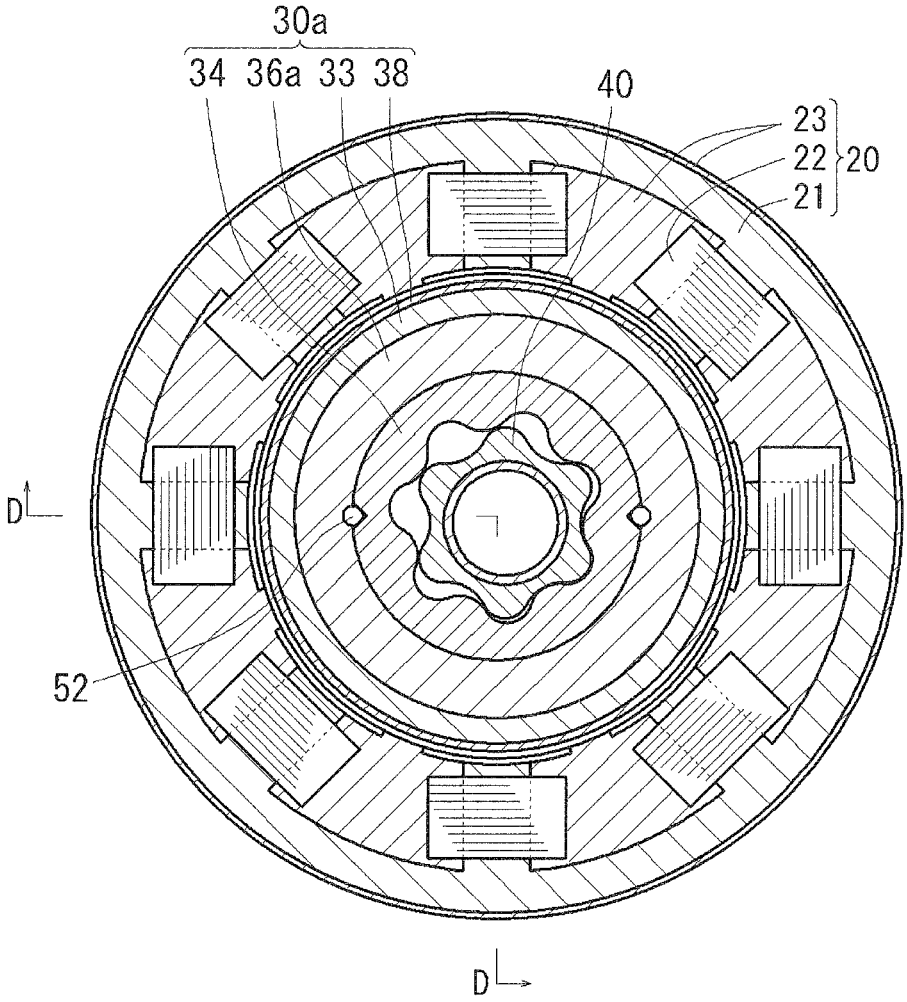
- FIG. 4 is a cross-sectional view taken along the line C-C in FIG. 3.
Figure 5:
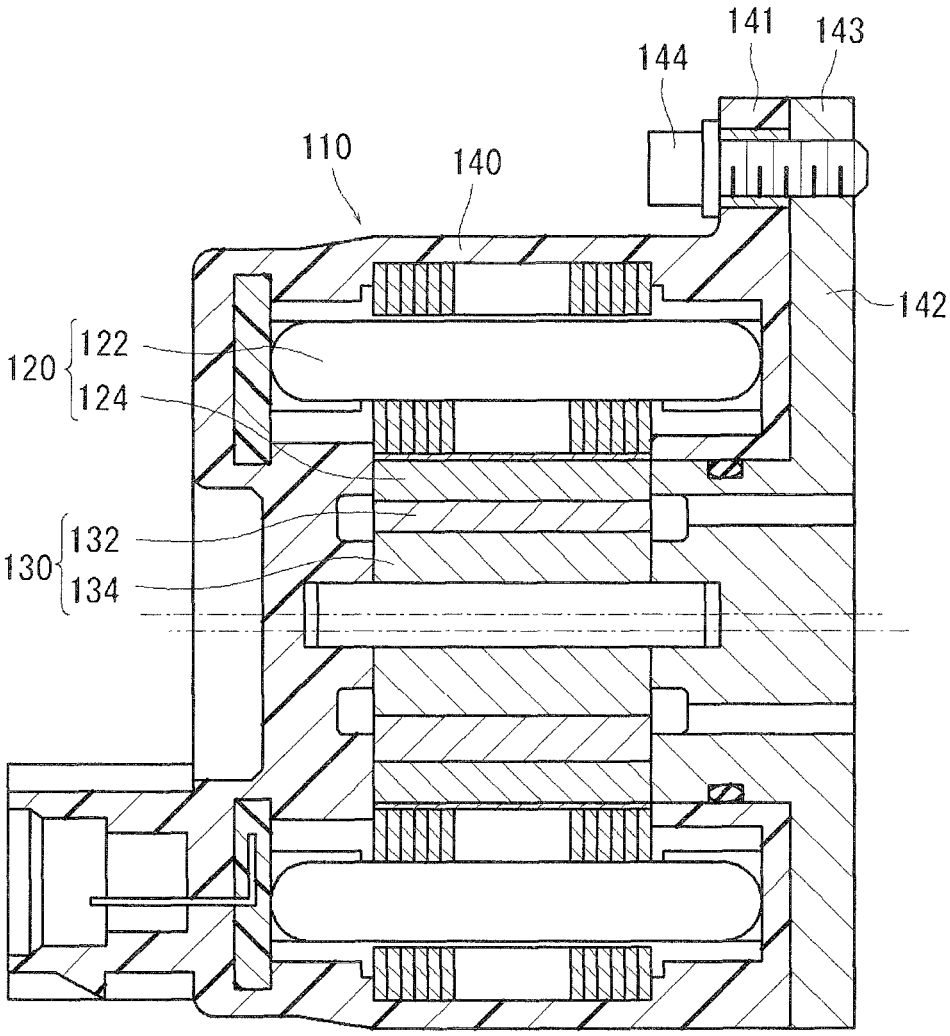
- FIG. 5 is an axial sectional view of an existing electric pump.

The structure of an electric pump according to a second embodiment will be described. FIG. 3 shows an axial sectional view of the electric pump 10*a* according to the second embodiment of the invention. FIG. 4 shows a cross-sectional view taken along the line C-C in FIG. 3. Note that the sectional view shown in FIG. 3 shows an axial sectional view taken along the line D-D in FIG. 4.

The electric pump 10*a* according to the second embodiment differs from the electric pump 10 according to the first embodiment in the structure of the outer rotor portion. An outer rotor portion 30*a* according to the second embodiment is formed in such a manner that a back yoke 36*a* is provided between the outer gear 34 and a cylindrical permanent magnet 33. The inner peripheral surface of the outer gear 34 is engaged with the outer peripheral surface of the inner rotor 40. The cylindrical permanent magnet 33 is rotated based on the magnetic field generated by the coil portion 22. A scattering prevention cover 38 is attached to the radially outer surface of the permanent magnet 33. An axial gap, formed in such a size that fluid is able to flow and entry of foreign matter contained in the fluid is suppressed, is formed at each of a position between one axial end surface of the outer rotor portion 30*a* and the axial end surface of the housing 60, which faces the one axial end surface of the outer rotor portion 30*a*, and a position between the other axial end surface of the outer rotor portion 30*a* and the axial end surface of the housing 62, which faces the other axial end surface of the outer rotor portion 30*a*. The other structure of the electric pump 10*a* is the same as that of the electric pump 10. Therefore, the same components as those of the electric pump 10 are denoted by the same reference numerals as those for the electric pump 10, and the detailed description thereof is omitted. Then, assembly of the electric pump 10*a* is performed in a similar procedure to that for the electric pump 10 according to the first embodiment.

According to the second embodiment, each of the axial gap between the outer rotor portion 30*a* and the housing 60 and the axial gap between the outer rotor portion 30*a* and the housing 62 is formed in such a size that entry of foreign matter from the outer gear 34-side to the permanent magnet 33-side is suppressed. Thus, it is possible to effectively suppress entry of foreign matter from the outer gear 34-side to the permanent magnet 33-side.

In the above embodiments, the support shaft portion is hollow. Alternatively, the support shaft portion may be solid. In addition, a structure in which the support shaft portion does not extend up to the surfaces of the housings and the support shaft portion is press-fitted into a recess formed on the inner side of the pair of housings may be employed to accommodate the support shaft portion at a position on the inner side of the housings. In the above embodiments, the paired housings are formed separately from the stator portion. Alternatively, a structure may be employed in which one of the housings is integrated with the stator portion and then the housing integrated with the stator portion and the separate housing are press-fitted onto the support shaft portion from respective ends of the support shaft portion to form the electric pump. In the above embodiments, the paired housings are press-fitted onto the support shaft portion. Alternatively, the paired housings may be fitted onto the support shaft portion and may be fixed to the support shaft portion by other fixing means, such as a bolt or an adhesive agent. In addition, a rotation stopper may be provided at each of spigot-engagement portions between the housings and the stator portion, and a flange that is used to fit the electric pump to a mounting-target member may be formed in the stator portion, The permanent magnet of the outer rotor portion may be in a shape that has a rib at its inner periphery as in the first embodiment, or may be in a cylindrical shape as in the second embodiment. In addition, in the outer rotor portion, the permanent magnet may be directly arranged on the outer periphery of the outer gear without providing a back yoke. Other than these above, the electric pump according to the invention may be implemented in various forms within the scope of the invention.

Figure 6A:
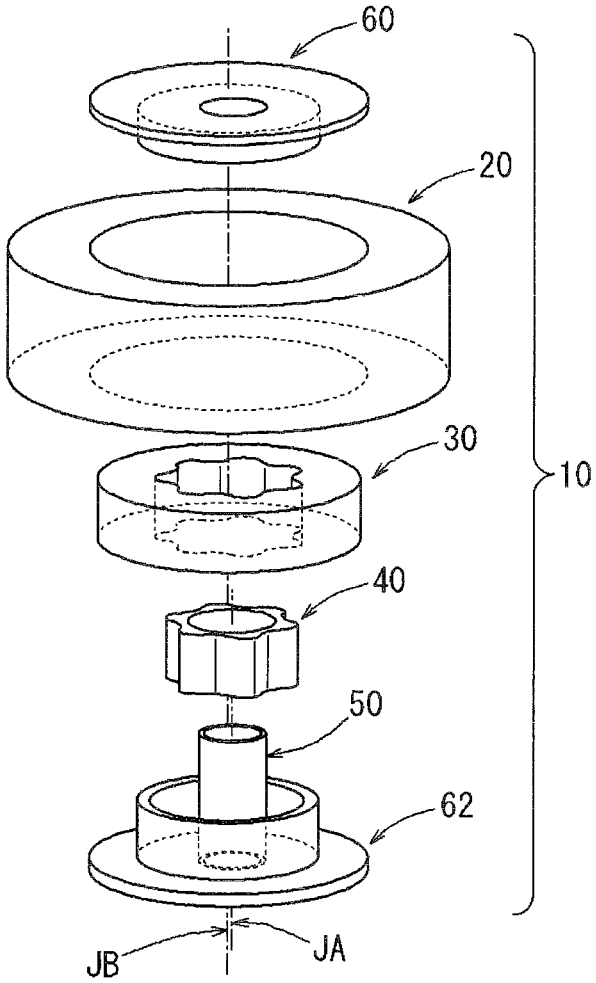
- FIG. 6A is an exploded perspective view of an electric pump 10 according to a third embodiment.
Figure 6B:
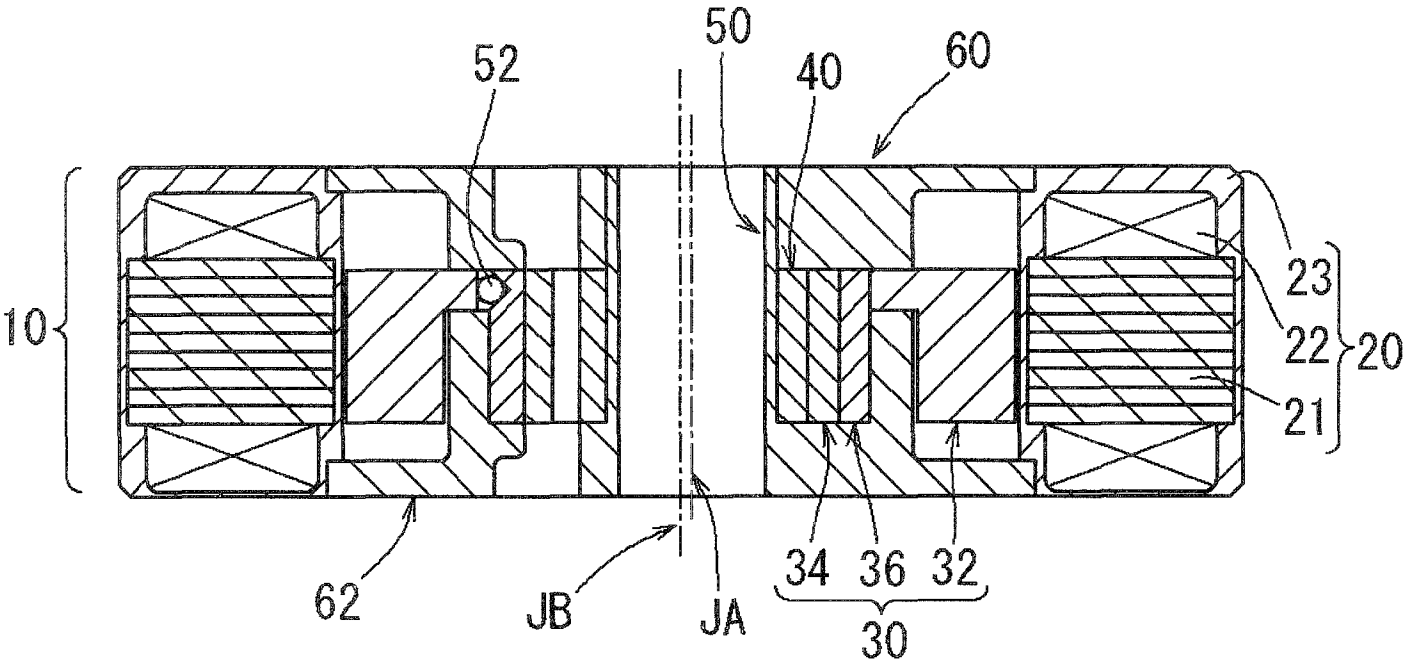
- FIG. 6B is an axial sectional view of the electric pump 10 according to the third embodiment.

The structure of an electric pump according to a third embodiment and a method of assembly of the electric pump will be described. FIG. 6A shows an exploded perspective view of the electric pump 10 according to the third embodiment. FIG. 6B shows an axial sectional view of the electric pump 10 according to the third embodiment. As shown in FIG. 6A and FIG. 6B, the structure of the electric pump 10 according to the third embodiment differs from that of the electric pump 10 according to the first embodiment (see FIG. 1 and FIG. 2) in that the support shaft portion 50 and the housing 62 (corresponding to the first housing) are integrally formed with each other. The assembly method in the third embodiment differs from that in the first embodiment in that it is not necessary to press-fit the housing 62 on the support shaft portion 50. Note that, as shown in FIG. 6B, the electric pump 10 according to the third embodiment differs from the electric pump 10 according to the first embodiment shown in FIG. 1 in the shape of the back yoke 36. However, as the first embodiment and the second embodiment, the back yoke 36 may have various shapes.

According to the third embodiment, it is possible to reduce the number of components and the man-hours required for the assembly work, and, consequently, it is possible to reduce time required for the assembly work and cost. Note that the support shaft portion 50 may be solid instead of being hollow. In addition, a structure may be employed in which the support shaft portion 50 does not pass through the second housing 60 and the support shaft portion 50 is press-fitted up to a midpoint of the second housing 60. Furthermore, the second housing 60 may not be press-fitted onto the support shaft portion 50. Alternatively, the second housing 60 may be fitted onto the support shaft portion 50 and fixed to the support shaft portion 50 by other fixing means, such as a bolt or an adhesive agent.

Figure 7A:
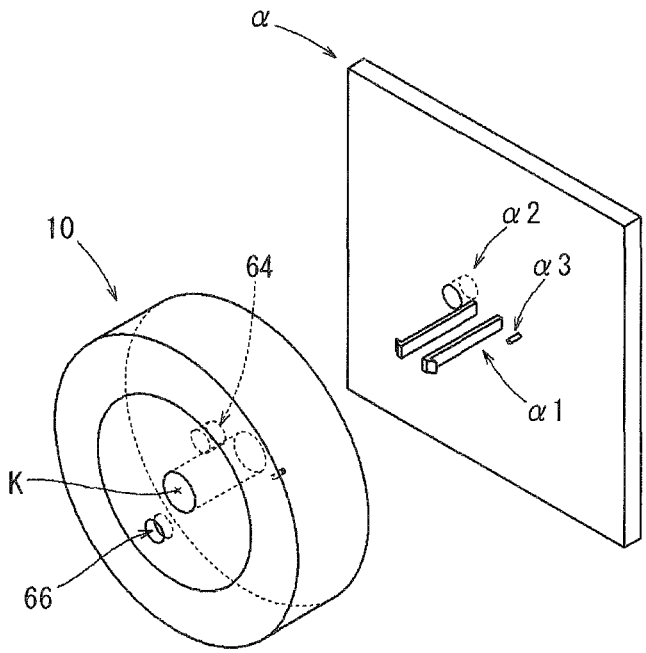
- FIG. 7A is a view that illustrates a manner of mounting the electric pump 10 on a mounting-target member $\alpha$ in a mounting structure for the electric pump 10.
Figure 7B:
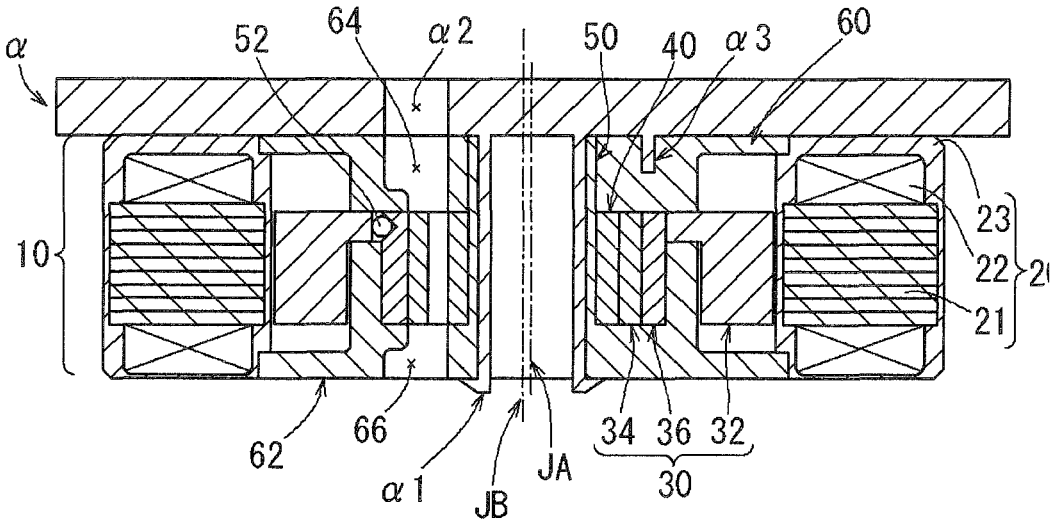
- FIG. 7B is an axial sectional view of the electric pump 10 that is mounted on the mounting-target member $\alpha$ in the mounting structure for the electric pump 10.
Figure 8:
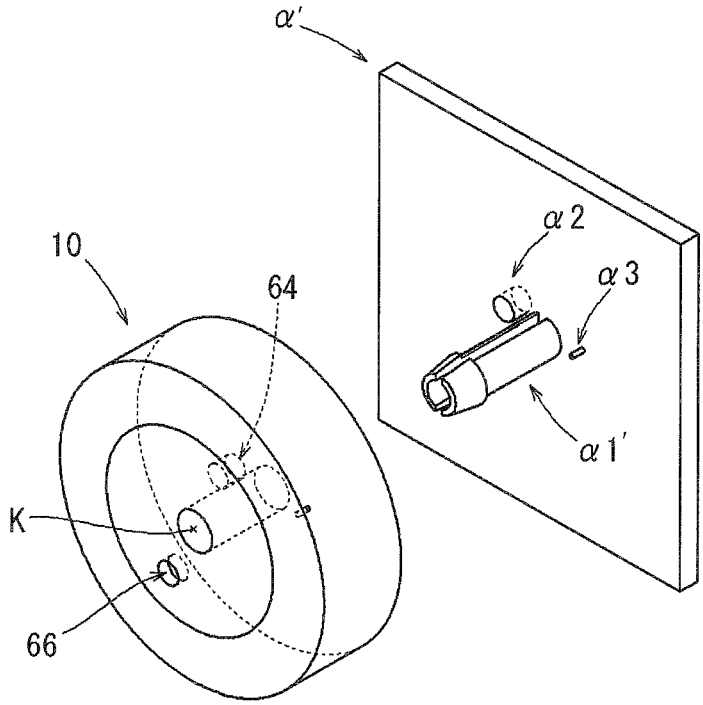
FIG. 8 is a view that illustrates a manner of mounting the electric pump 10 on a mounting-target member α' in a mounting structure for the electric pump 10 in another example.

An example of a mounting structure for the electric pump 10 will be described. FIG. 7A shows a schematic perspective view of the electric pump 10 and a mounting-target member α on which the electric pump 10 is to be mounted in the mounting structure for the electric pump 10. FIG. 7B shows an axial sectional view of a state where the electric pump 10 is mounted on the mounting-target member α. FIG. 8 shows a schematic perspective view of the electric pump 10 and a mounting-target member α' that is another example of a member on which the electric pump 10 is to be mounted in a mounting structure for the electric pump 10.

As shown in FIG. 7A and FIG. 7B, as an example of the structure for mounting either one of the electric pumps 10 and 10*a* described in the first to third embodiments to the mounting-target member α, a fixing members α1 (mounting member) that can be passed through the through-hole of the support shaft portion 50 is provided on the mounting-target member α. In addition, as shown in FIG. 7A, lugs are formed at the end of the fixing members α1. The lugs are engaged with a surface of the electric pump 10 through which the fixing member α1 has been passed. The surface, with which the lugs are engaged, is on the opposite side from the mounting-target member α. In addition, the fixing member α1 is structured so as to be deformable in such a manner that the diameter thereof may be decreased (in this case, a slit of a split structure is formed). In addition, a fluid introducing port α2 is formed in the mounting-target member α at a position facing the outlet 64 of the electric pump 10. The fluid chained from the electric pump 10 passes through the fluid introducing port α2.

With the above structure, in order to mount the electric pump 10 on the mounting-target member α, a worker just aligns the through-hole K of the support shaft portion 50 of the electric pump 10 with the end of the fixing member α1 and then pushes the electric pump 10 toward the mounting-target member α. Thus, the fixing member α1 passes through the through-hole K and then the distance between the lugs at the end of the fixing member α1 is increased. As a result, the electric pump 10 is fixed so as not to slip off the fixing member α1 (the electric pump 10 is engaged with the lugs). At the same time, the outlet 64 of the electric pump 10 is connected to the fluid introducing port α2. In addition, as shown in FIG. 7A and FIG. 7B, preferably, a rotation stopper α3 for preventing rotation of the electric pump 10 about the fixing member α1 is provided. Note that the rotation stopper α3 is formed of a pair of a protrusion (corresponding to the rotation stopper α3 in FIG. 7A) and a corresponding recess (recessed shape, not shown). The protrusion may be provided on the mounting-target member α and the recess (recessed shape) may be formed in the electric pump 10. Alternatively, the protrusion may be provided on the electric pump 10 and the recess (recessed shape) may be formed in the mounting-target member α. Various structures other than the above-described structure may be employed as the structure of the rotation stopper. The mounting-target member α on which the electric pump 10 is mounted may be replaced with a mounting-target member α' that is provided with a fixing member α1' shown in FIG. 8 instead of the fixing member α1 shown in FIG. 7A.

With the above-described mounting structure for the electric pump, a bolt used to mount the electric pump on the mounting-target member α is no longer required. Therefore, the number of components may be reduced, and the electric pump 10 may be considerably easily mounted on the mounting-target member α in a short period of time. In addition, the electric pump 10 no longer requires flanges used to mount the electric pump 10 on the mounting-target member α. Therefore, the size and weight of the electric pump 10 are reduced, and a smaller mounting space is required. In addition, the structure may be employed in which the support shaft portion 50 does not pass through the second housing 60 and the support shaft portion 50 is press-fitted up to a midpoint of the second housing 60. In addition, the electric pump 10 according to the invention has the inlet 66 formed in the first housing 62 and the outlet 64 formed in the second housing 60. Therefore, it Is possible to pump up fluid just by immersing the axial end surface of the first housing 62 in the fluid. Thus, another pipe member for pumping up fluid is no longer required. Therefore, the number of components is reduced.

As described above, the electric pump 10 and the mounting structure for the electric pimp 10 according to the invention are not limited to the appearances, configurations, structures, and the like, described in the above embodiments. Various modifications, additions or deletions may be made within the scope of the invention. Rotation stoppers may be provided at the spigot-engagement portions between the housings and the stator portion, and a flange that is used to mount the electric pump on a mounting-target member may be provided at the stator portion. In addition, various shapes may be employed as the shape of the permanent magnet of the outer rotor portion. In addition, the outer rotor portion may be structured such that the permanent magnet is directly arranged on the outer periphery of the outer gear and no back yoke is provided.

As described above, the electric pump according to each of the embodiments of the invention includes: the housing; the annular stator portion that has the coil portion; the outer rotor portion that is arranged coaxially with the stator portion, at a position on the inner side of the stator portion, and that is rotated based on the magnetic field generated by the coil portion; and the inner rotor that is rotatably supported, at a position on the inner side of the outer rotor portion, by the support shaft portion that is supported at the axial position offset from the rotation axis of the outer rotor portion, and that has the outer peripheral surface that is engaged with the inner peripheral surface of the outer rotor portion. The housing is formed of the first housing and the second housing that are separated from each other in the axial direction. The first housing is fixed to the support shaft portion, and the second housing is fitted on the support shaft portion from one side of the support shaft portion in the axial direction, and is fixed to the one side portion of the support shaft portion. Then, the stator portion is clamped between the first housing and the second housing fixed to the support shaft portion from both sides in the axial direction. The first housing and the second housing rotatably hold the outer rotor portion and the inner rotor from both sides in the axial direction.

According to the above embodiments, the first housing and the second housing are separated from each other in the axial direction. The support shaft portion is fixed to the first housing and the second housing is fitted on the support shaft portion, whereby the outer rotor portion and the stator portion are clamped between the first housing and the second housing from both sides in the axial direction. Thus, the components that constitute the electric pump are assembled together. Thus, flanges used for assembly are no longer required. Therefore, it is possible to reduce the size in the radial direction and make the mounting surface, on which the electric pump is mounted, small. In addition, a bolt used to assemble the housings together is no longer required. Therefore, the number of components is reduced. Then, assembly of the electric pump is performed just by press-fitting the second housing on the support shaft portion to which the first housing has been fixed. Therefore, the assembly work is easy.

In the above electric pump, each of the first housing and the second housing may have the spigot-engagement portion used for spigot-engagement with the stator portion. With the above structure, the stator portion is clamped and fixed between the pair of housings (first housing and second housing) using the spigot-engagement portions. Therefore, the housings and the stator portion may be easily assembled together with a high degree of accuracy.

In the above electric pump, the first housing and the support shaft portion may be integrally formed with each other. Alternatively, the first housing may be fitted onto the support shaft portion from the other side of the support shaft portion in the axial direction, and may be fixed to the other side portion of the support shaft portion, If the first housing and the support shaft portion are integrally formed with each other, it is possible to further reduce the number of components and further simplify the assembly work. In addition, if the first housing is fitted onto the support shaft portion from the other side of the support shaft portion in the axial direction and is fixed to the other side portion of the support shaft portion, the first housing may be easily fixed to the support shaft portion.

Furthermore, in the electric pump according to the above embodiments, a structure may be employed in which the support shaft portion has a hollow shape and has a through-hole extending in the axial direction and the electric pump is fixed to the mounting-target member by inserting a fixing member into the through-hole of the support shaft portion. With this structure, by inserting the fixing member, such as a bolt, into the through-hole of the support shaft portion, it is possible to easily fix the electric pump to the mounting-target member.

The electric pump mounting structure according to the embodiment of the invention is an electric pump mounting structure for fixing the electric pump that includes the hollow support shaft portion having the through-hole extending in the axial direction to a mounting-target member. In the electric pump mounting structure according to the embodiment, the mounting-target member has the fixing member that is able to be passed through the through-bole of the support shaft portion, and the lugs that are engaged with the surface of the electric pump, through which the fixing member has been passed, are formed at the end of the fixing member. The surface with which the lugs are engaged is on the opposite side from the mounting-target member. With the above structure, the mounting-target member on which the electric pump is mounted has the fixing member having the Jugs at its end. Thus, the electric pump is easily mounted on the mounting-target member in a short period of time.

The invention claimed is:

1. An electric pump comprising:

a housing;

an annular stator portion that has a coil portion;

an outer rotor portion that is arranged coaxially with the stator portion, at a position on an inner side of the stator portion, and that is rotated based on a magnetic field generated by the coil portion; and an inner rotor that is rotatably supported, at a position on an inner side of the outer rotor portion, by a support shaft portion that is supported at an axial position offset from a rotation axis of the outer rotor portion, and that has an outer peripheral surface that is engaged with an inner peripheral surface of the outer rotor portion, wherein the housing is formed of a first housing and a second housing that are separated from each other in an axial direction, the first housing is fixed to the support shaft portion, the second housing is press-fitted to the support shaft portion from one side of the support shaft portion in the axial direction, and is fixed to a portion of the support shaft portion, the portion being on the one side, and the stator portion is clamped between the first housing and the second housing fixed to the support shaft portion from both sides in the axial direction, and the outer rotor portion and the inner rotor are rotatably held between the first housing and the second housing from both sides in the axial direction.

2. The electric pump according to claim 1, wherein each of the first housing and the second housing has a spigot-engagement portion used for spigot-engagement with the stator portion.

3. The electric pump according to claim 1, wherein the first housing and the support shaft portion are integrally formed with each other.

4. The electric pump according to claim 1, wherein the first housing is fitted onto the support shaft portion from another side of the support shaft portion in the axial direction and is fixed to a portion of the support shaft portion, the portion being on the other side.

5. The electric pump according to claim 1, wherein the support shaft portion has a hollow shape, and has a through-hole extending in the axial direction, and the support shaft portion is structured so as to be fixed to a mounting-target member of an electric pump mounting structure by inserting a fixing member attached to the mounting-target member into the through-hole of the support shaft portion.

6. An electric pump mounting structure that fixes the electric pump according to claim 5 to the mounting-target member of the electric pump mounting structure, wherein the mounting-target member has the fixing member that is able to be passed through the through-hole of the support shaft portion, and a lug that is engaged with a surface of the electric pump, through which the fixing member has been passed, is formed at an end of the fixing member, and the surface is located on a side of the electric pump that is opposite a second surface of the electric pump nearest to the mounting-target member.

* * * * *